United States Patent [19]

Sawatzki

[11] 4,449,650

[45] May 22, 1984

[54] METERING PUMP ESPECIALLY FOR VOLATILE MATERIALS

[75] Inventor: Harry Sawatzki, Vaduz, Liechtenstein

[73] Assignee: Censor Patent- Und Versuchs-Anstalt, Vaduz, Liechtenstein

[21] Appl. No.: 323,082

[22] Filed: Nov. 19, 1981

[51] Int. Cl.[3] ..... B65D 88/54; B67D 5/40

[52] U.S. Cl. ..... 222/309; 137/539; 141/116; 222/334; 222/380; 222/496

[58] Field of Search ..... 222/334, 309, 318, 496, 222/380, 383, 108, 375; 137/539; 141/115, 116, 117, 286, 301, 302

[56] References Cited

U.S. PATENT DOCUMENTS

| | | | |
|---|---|---|---|
| 3,302,662 | 2/1967 | Webb | 137/539 |
| 3,851,801 | 12/1974 | Roth | 222/383 X |
| 3,913,801 | 9/1975 | Wise et al. | 222/375 |
| 3,976,250 | 8/1976 | Bentzinger | 222/335 X |
| 4,197,875 | 4/1980 | Schieferstein et al. | 137/539 X |
| 4,358,027 | 11/1982 | Poitras | 222/309 X |

*Primary Examiner*—Robert B. Reeves
*Assistant Examiner*—Russell D. Stormer
*Attorney, Agent, or Firm*—Karl F. Ross; Herbert Dubno

[57] ABSTRACT

A dosing pump for metering a predetermined quantity of a displaceable material, usually a solvent-containing fluid substance, per stroke of the pump, comprises a chamber connected by an intake valve with a source of the material and with a discharge valve with a location into which the material is to be dispensed. The chamber is provided with a drive member, e.g. a membrane or piston, preferably actuatable by fluid pressure and, according to the invention, at least one displaceable member whose stroke is such that it corresponds to a displacement of material less than the displacement by the drive member and is effective upon retraction of the drive member to allow the material to recede slightly from the outlet of the pump without re-entering the chamber.

3 Claims, 4 Drawing Figures

METERING PUMP ESPECIALLY FOR VOLATILE MATERIALS

FIELD OF THE INVENTION

My present invention relates to a metering pump and, more particularly, to a metering pump for the feeding, dispensing or delivery of a predetermined quantity of a material, especially a material containing a volatile component, per stroke of a drive member.

BACKGROUND OF THE INVENTION

Metering or dosing pumps are devices capable of delivery of predetermined quantities of material per unit of time or per unit of the operation of an activating system, and may be used in a wise variety of material feed applications.

For example, the fuel-injection pump of a diesel engine can be considered a metering or dosing pump as defined above because predetermined quantities of the diesel fuel are delivered per stroke of the pump.

Such pumps also have application in the food industry, in the pharmaceutical field, in chemical processing and in the synthetic resin field, as well as in industry and research generally. Indeed, such pumps are commercially available in a variety of configurations with various drives and various capacities.

In one class of metering pump, a reciprocating drive member serves to displace the material. In this system a chamber is provided and communicates via an intake or suction valve with a source of the material to be dispensed, e.g. a reservoir containing the material under pressure, under a hydrostatic head or under no pressure, the chamber also being connected via an outlet or discharge valve with a pump outlet which is preferably fitted with a nozzle, i.e. a small-cross section elongated discharge passage.

Upon the retraction stroke, the drive member is shifted in a direction tending to expand the chamber and material from the reservoir is induced to flow through the unidirectional or check valve at the intake into the chamber while the unidirectional or check valve at the discharge prevents retraction of material from the outlet passage and nozzle.

Upon the displacement stroke of the drive member the volume of the chamber is reduced and the fluid within the chamber is forced past the discharge valve, the presssure within the chamber developed by advance of the drive member blocking the intake valve.

Cycling in this manner with the stroke of the drive member precisely determined, feeds a predetermined quantity of the material from the outlet with each forward stroke of the drive member which can be a piston (plunger) or membrane.

The drive member itself can be displaced by fluid pressure applied to a side thereof opposite the side exposed to the material which is displaced.

While such pumps are widely used and in diverse fields of application, problems are encountered when the material is or contains a volatile substance. The term "volatile substance" is here used to describe any material which has an extremely high vapor pressure at the temperature at which the pump is to operate so that a surface of the material exposed to the atmosphere will suffer a change because of evaporation of the volatile substance. Such volatile substances can be fuels but most often are solvents forming vehicles for other materials.

Hence upon evaporation of the volatile substance with exposure to the atmosphere a change in the composition of the material can occur.

Since the outlet of the pump is generally exposed to the atmosphere, and the displacement of the material by the drive member brings the material to the very end of the outlet where it may be exposed to air and evaporation of the volatile substance can occur, various problems result. For example, because of loss of the solvent at the tip of the outlet nozzle, the concentration of other materials will increase and the viscosity will change. Both the change in viscosity and composition are generally detrimental to sensitive operations.

With certain materials, e.g. synthetic resins, a skin or film may harden at the exposed air/material interface so that obstruction of the pump can occur or further displacement may carry a heterogeneous product into any collecting passage or chamber. This problem is most pronounced where relatively long interludes separate the feed strokes of the pump so that contamination or evaporation at the interface is especially high.

OBJECTS OF THE INVENTION

It is the principal object of the present invention to provide an improved dosing or metering pump for high precision metering of materials whereby the disadvantages enumerated above and encountered where such materials contain volatile substances, are obviated.

Still another object of this invention is to provide a dosing pump specifically for materials containing volatile substances such as solvents, or where the materials might be contaminated by the air/material interface after a feed stroke, whereby the disadvantages of earlier pumps are overcome.

SUMMARY OF THE INVENTION

These objects and others which will become apparent hereinafter, are attained in accordance with the present invention, in a dosing pump having, in the manner described, a drive member, a chamber and intake and discharge valves wherein, between the chamber and the discharge passage, a displacement member or body is provided whose stroke is such that its displacement volume is less than the volume displaced by the drive member and which is retracted upon completion of a feed stroke of the drive member to cause the end of the stream of material to recede from the tip of the discharge nozzle and hence to withdraw it within the discharge passage without allowing its re-entry into the chamber. Thus, the precision of metering of the material by the drive member is not affected by the presence of the displacement body but exposure of the material in the outlet passage to air is limited by causing said exposure at best to occur well within the discharge passage.

In other words, after each working stroke of the dosing pump a portion of the displacement medium is retracted or sucked back so that the outer boundary of this medium lies within the discharge passage and hence is recessed from direct contact with environment. This contact is further minimized by making the cross section of the discharge passage as small and as long as possible, e.g. in the shape of a nozzle, so that solvent loss by evaporation requires diffusion of the solvent through the space between the material surface and the end of the outlet passage, a phenomenon which is practically negligible.

According to a first embodiment of the invention, the displacement body is a membrane which can be equipped with a discharge valve and has its stroke limited in the forward direction. Thus, this membrane which can be prestressed to draw it back toward the pump chamber, is displaced by the forward movement of the material through the discharge passage and, upon closure of the discharge valve, recedes to retract a small volume of the material, thereby moving the material significantly backwards in the elongated nozzle passage.

In the second embodiment of the invention, the valve member of the discharge valve itself forms the displacement body in that it can recede after valve closure with its recession corresponding to retraction of a predetermined quantity of the displaced medium.

It has also been found to be possible, in the third embodiment of the invention, to provide a bypass for the discharge valve which includes a chamber containing the displacement member which can be a ball shiftable in the cylindrical chamber and with a stroke limited by a appropriate adjustment means.

BRIEF DESCRIPTION OF THE DRAWINGS

The above and other objects, features and advantages of the present invention will become more readily apparent from the following description, reference being made to the accompanying drawing in which.

SPECIFIC DESCRIPTION

Figure 1:
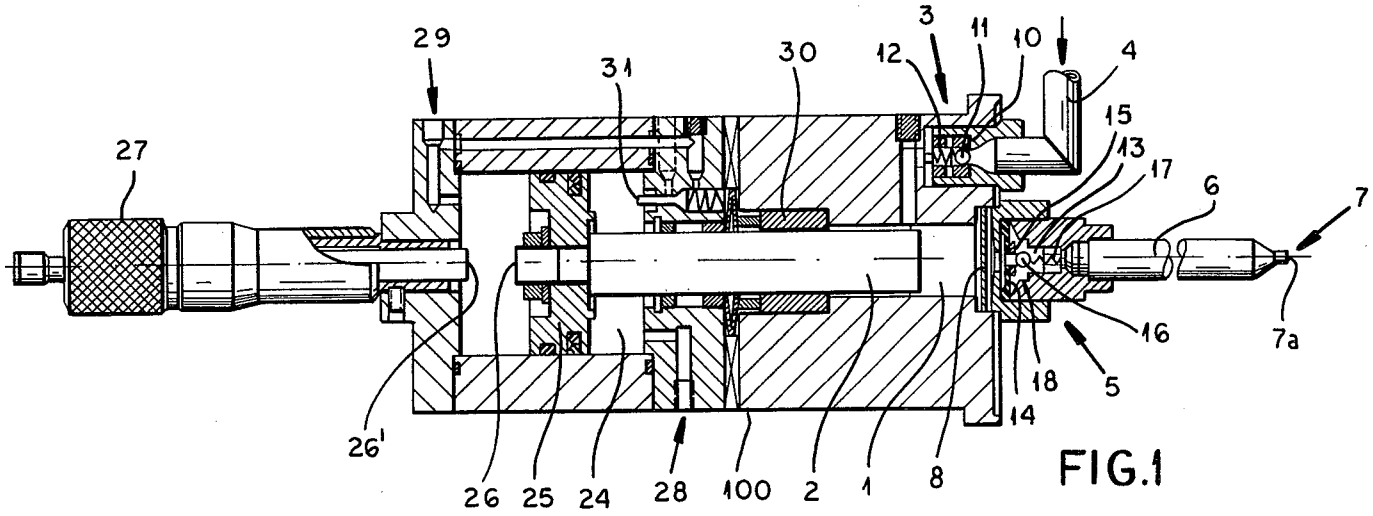
FIG. 1 is an axial cross-sectional view through a metering pump according to the invention, some portions being shown in elevation.

The dosing pump shown in the drawing comprises a body 100 formed with an axially extending pump chamber 1 of cylindrical configuration in which a plunger 2 is axially reciprocatable to displace the medium or material to be fed to a nozzle 7.

The plunger 2, which is slidable in the seal 30, thus forms a drive member of the metering pump. It will be understood that this member can be replaced by a membrane or can displace a membrane forming the drive member and in place of the piston used for displacing the plunger 2, the fluid can be applied directly to this plunger or to the membrane.

However, in the best mode embodiment of the invention, the plunger 2 is connected to a piston 25 which is axially shiftable in a cylinder 24.

The cylinder 24 is formed with a pressure port 29 which can be supplied with a hydraulic medium through a check valve 31 to drive the piston 25 and hence the plunger 2 to the right in the feed stroke. A port 28 can be supplied with the operating medium to shift the piston 25 to the left thereby drawing the plunger 2 in this direction and increasing the volume of the chamber 1.

The stroke of the piston 25 and hence of the plunger 2 is controlled by a micrometer spindle 27 whose abutment 26' is engageable with an abutment 26 carried by the piston 25. By thus limiting the retraction stroke, the forward stroke (pump displacement) of piston 25 is controlled and hence it is possible to regulate the displacement per stroke by the plunger 2.

In place of the fluid operation of the plunger 2, I can substitute other mechanical, electrical or other motive force utilizing electrical or mechanical drives in place of the fluid motor described.

The pump chamber 1 is provided with an intake or suction valve 3 connected via a suction line 4 with a reservoir containing the material to be metered by the pump, e.g. a material containing a substance of high volatility.

The intake valve 3 is a conventional check valve preventing flow of material from the chamber 1 outwardly and comprising a valve seat 10, a valve body in the form of a ball 11 and a valve spring 12 biasing this ball against the seat.

A filter disk 8 is provided at the discharge site of the chamber 1, ahead of a discharge valve 5 which is connected via a discharge passage 6 with a nozzle 7 previously mentioned.

The tip *7a* of the nozzle is open to the atmosphere and the environment.

The discharge valve 5 comprises a valve seat 15, a valve ball 16 and a spring 17 biasing this ball against the seat, this valve 5 thereby forming a check valve preventing flow of material into the chamber 1.

The valve seat 15 is, according to the invention, mounted upon a resilient membrane 14 which can be deflected to the right until it engages the abutment 18.

Figure 4:
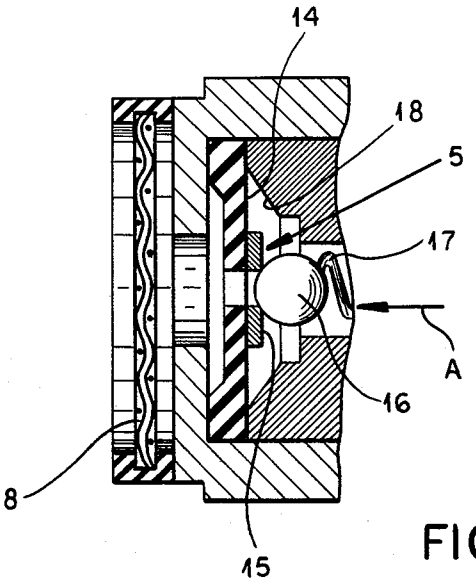
FIG. 4 is a detail view drawn to a larger scale of a portion of the discharge valve assembly of FIG. 1.

Thus, when the plunger 2 is drawn to the left for the intake stroke of the pump, material is drawn in to the chamber 1 through the valve 3 and during the forward stroke, after the membrane has been deflected toward the right, the valve 5 opens to permit discharge of the predetermined quantity of material from the nozzle 7, the deflection of the membrane having previously pressed the material within the discharge passage 6 back to the opening *7a*. When the feed stroke terminates and the plunger 2 begins its retraction movement, the membrane 14 returns to its position shown in FIGS. 1 and 4, thereby drawing material in the direction of arrow A away from the opening *7a* although the closing of valve 5 previously prevents this material from returning to the chamber 1.

Since the material is now set back from the opening *7a*, contamination and evaporation are minimized.

Figure 2:
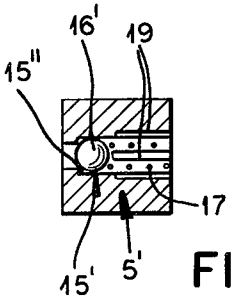
FIG. 2 is a detail view of a discharge valve in accordance with the second embodiment of the invention.

In the second embodiment of the invention shown in FIG. 2, the check valve 5' is not formed on a membrane but rather has its ball 16' axially shiftable in a cylindrical bore 15', a seat 15'' and a position in which radial outlets 19 are provided.

The spring 17 biases the ball 16' to the left as shown in FIG. 2.

Thus, during the discharge stroke from the pump, which otherwise can have the configuration shown in FIG. 1, the ball 16' moves from the position illustrated to drive previously retracted material back toward the opening *7a*. During the forward stroke of the plunger 2, the ball moves still further to the right to unblock the openings 19 and permit the dose of material to be fed from the chamber to the discharge passage around the ball 16'.

When the plunger 2 begins its return stroke, the ball 16 enters the cylindrical bore 15' and thereby blocks communication between the passage 19 and the chamber. Further movement of the ball 16' to the left draws material from the nozzle inwardly with the effect described previously. Thus, the volume retracted is equal to the volumetric displacement of the ball 16' within the bore 15'.

Figure 3:
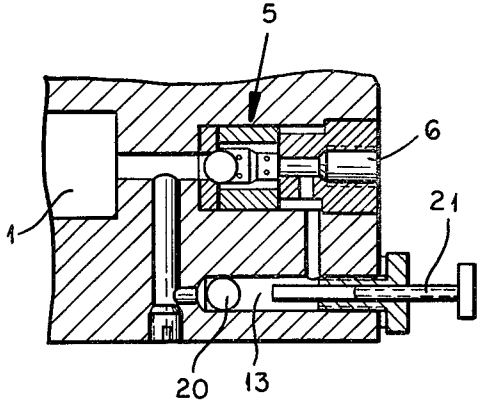
FIG. 3 is a detail view of the discharge side of the pump according to the invention formed with a bypass in accordance with the third embodiment of the invention.

In the third embodiment (FIG. 3) a cylindrical bore 13 is provided in a bypass across the check valve 5, i.e. between the discharge passage 6 and the chamber 1, and is formed with a ball 20 whose displacement is limited by the threaded spindle 21 which forms a stop to the right for this ball.

Since the ball 20 is not spring-loaded, the feed stroke of the plunger 2 builds up pressure to the left of the ball 20, thereby displacing it to the right and driving previously retracted material to the nozzle tip. When the ball 20 is stopped by the spindle 21, the continued pressure of the fluid opens the check valve 5 and the requisite quantity of material is fed to the discharge passage around the ball thereof. During the return stroke of the plunger 2, the valve 5 closes and as the ball 20 moves to the left, it draws the displaced material through the discharge passage and away from the tip. The degree to which the material is retracted from the tip is controlled by the spindle 21 and the displacement of the ball 20 around which the material cannot flow.

I claim:

1. A dosing pump, especially for a flowable material containing a volatile substance, comprising:

a pump housing formed with a pump chamber;

a drive member displaceable in said chamber to vary the effective volume thereof in a feed stroke driving said material from said chamber and an intake stroke drawing said material into said chamber;

means connected to said drive member for displacing same in said chamber;

an intake valve connected to said chamber for unidirectionally admitting said material to said chamber during said intake stroke;

a discharge valve connected to said chamber for unidirectionally permitting outflow of said material from said chamber;

a discharge passage connected to said discharge valve for conducting said material therefrom; and displacement means including a displacement body disposed between said discharge passage and said chamber and displaceable during an initial portion of said feed stroke to force a quantity of said material along said passage, said quantity of material being less than the quantity of material displaced by said drive member during said feed stroke and determined by the extent of movement of said displacement body whereby movement of said displacement body during said intake stroke retracts material in said passage, thereby reducing exposure of a boundary surface of said material to the environment, said displacement body comprising a membrane disposed in a path between said passage and said chamber, a stop formed by an end of said passage proximal to said membrane for limiting the deflection of said membrane during said feed stroke, said discharge valve including a valve seat formed on said membrane, said membrane being prestressed in a manner tending to draw it toward said chamber.

2. A dosing pump, especially for a flowable material containing a volatile substance, comprising:

a pump housing formed with a pump chamber;

a drive member displaceable in said chamber to vary the effective volume thereof in a feed stroke driving said material from said chamber and an intake stroke drawing said material into said chamber;

means connected to said drive member for displacing same in said chamber;

an intake valve connected to said chamber for unidirectionally admitting said material to said chamber during said intake stroke;

a discharge valve connected to said chamber for unidirectionally permitting outflow of said material from said chamber;

a discharge passage connected to said discharge valve for conducting said material therefrom; and displacement means including a displacement body disposed between said discharge passage and said chamber and displaceable during an initial portion of said feed stroke to force a quantity of said material along said passage, said quantity of material being less than the quantity of material displaced by said drive member during said feed stroke and determined by the extent of movement of said displacement body whereby movement of said displacement body during said intake stroke retracts material in said passage, thereby reducing exposure of a boundary surface of said material to the environment, said displacement means being provided in a bypass across said discharge valve.

3. The pump defined in claim 2 wherein said displacement body is a ball shiftable in a cylindrical bore formed in said housing, said pump further comprising an adjustable abutment limiting the displacement of said ball in said bore.

* * * * *